US009308551B2

(12) United States Patent
Zhou et al.

(10) Patent No.: US 9,308,551 B2
(45) Date of Patent: Apr. 12, 2016

(54) SURFACE TREATMENT METHOD FOR SUBSTRATE AND HOUSING MANUFACTURED BY THE SAME

(71) Applicants: SHENZHEN FUTAIHONG PRECISION INDUSTRY CO., LTD., Shenzhen (CN); FIH (Hong Kong) Limited, Kowloon (HK)

(72) Inventors: Shu-Xiang Zhou, Shenzhen (CN); Hong-Liang Wang, Shenzhen (CN); He-Xian Lin, Shenzhen (CN)

(73) Assignees: SHENZHEN FUTAIHONG PRECISION INDUSTRY CO., LTD., Shenzhen (CN); FIH (Hong Kong) Limited, Kowloon (HK)

( * ) Notice: Subject to any disclaimer, the term of this patent is extended or adjusted under 35 U.S.C. 154(b) by 408 days.

(21) Appl. No.: 13/873,417

(22) Filed: Apr. 30, 2013

(65) Prior Publication Data

US 2014/0120283 A1 May 1, 2014

(30) Foreign Application Priority Data

Oct. 25, 2012 (CN) ..... 2012 1 04125100

(51) Int. Cl.

| | |
|---|---|
| ***B05D 1/02*** | (2006.01) |
| ***B05D 7/00*** | (2006.01) |
| *B05D 5/06* | (2006.01) |

(52) U.S. Cl.

CPC *B05D 1/02* (2013.01); *B05D 7/546* (2013.01); *B05D 5/067* (2013.01); *B05D 7/576* (2013.01); *B05D 2350/65* (2013.01); *Y10T 428/1359* (2015.01)

(58) Field of Classification Search

CPC ..... B05D 1/02; B05D 7/546; B05D 5/067; B05D 7/576; B05D 2350/65; Y10T 428/1359

See application file for complete search history.

(56) References Cited

U.S. PATENT DOCUMENTS

2002/0197492 A1* 12/2002 Hao ..... C25D 5/022 428/457

* cited by examiner

*Primary Examiner* — Michael C Miggins

(74) *Attorney, Agent, or Firm* — Novak Druce Connolly Bove + Quigg LLP

(57) ABSTRACT

A surface treatment method for substrate includes: spraying liquid is provided, the spraying liquid includes silane coupling agent, leveling agent, isopropyl alcohol, ethanol, acetic acid and water; a substrate having a metallic coating disposed thereon is provided; the spraying liquid is sprayed on the metallic coating, and then spraying liquid is baked to form a transparent protecting layer on the metallic coating; and a painting layer is formed on the protecting layer. The housing formed by the surface treatment method is also provided.

6 Claims, 1 Drawing Sheet

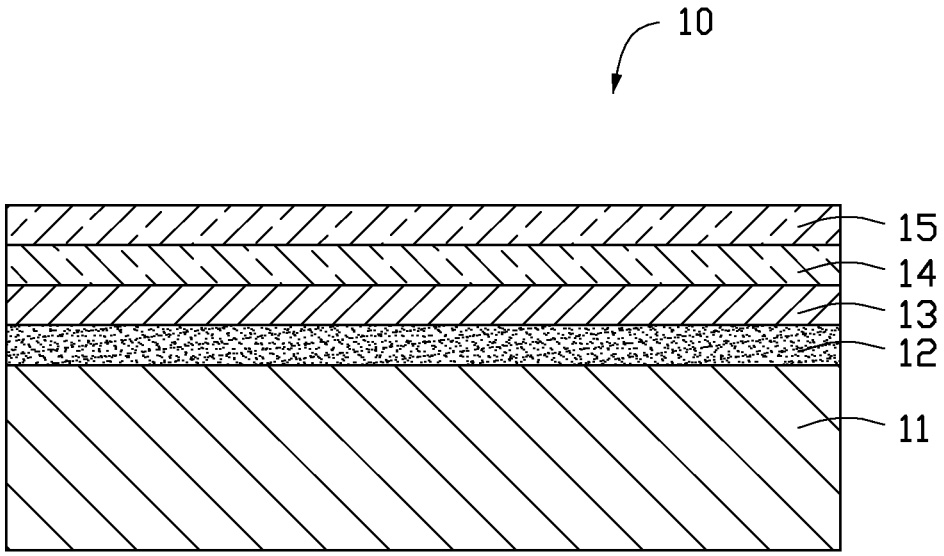
10
15
14
13
12
11

SURFACE TREATMENT METHOD FOR SUBSTRATE AND HOUSING MANUFACTURED BY THE SAME

BACKGROUND

1. Technical Field

The exemplary disclosure generally relates to a surface treatment method for substrate and a housing manufactured by the surface treatment method.

2. Description of Related Art

Vacuum metalizing process is widely used to form metallic coatings on housings of electronic devices. Traditional vacuum metalizing process includes the following steps: forming a base paint on the housing; forming a metallic coating on the base paint; forming a middle paint coating on the metallic coating; and forming a top paint coating on the middle paint coating. The middle paint coating and the top paint coating can prevent the metallic coating from abrasion and erosion. However, the middle paint coating and the top paint coating are prone to peel off from the metallic coating.

Therefore, there is room for improvement within the art.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the exemplary disclosure. Moreover, in the drawings like reference numerals designate corresponding parts throughout the several views.

The figure is a cross-sectional view of an exemplary embodiment of a housing.

DETAILED DESCRIPTION

Referring to FIG. 1, an exemplary surface treatment method for substrate may include at least the following steps:

(1) A spraying liquid is manufactured.

The spraying liquid is formed by the following steps:

(a) a coupling agent solution is produced by mixing a silane coupling agent and a leveling agent, the mass percentage of the leveling agent with regard to the coupling agent solution is about 1.5% to about 3%;

(b) 3-5 parts of coupling agent solution by mass, 80-85 parts of isopropyl alcohol by mass, 5-8 parts of ethanol by mass, 5-8 parts of water by mass, and 1-3 parts of acetic acid solution by mass are mixed to produce a mixture;

(c) the mixture is stirred and then left standing to hydrolyze the silane coupling agent, thus producing a transparent spraying liquid.

In the embodiment, the mixture is left standing for about 30 min

The silane coupling agent includes epoxy group(s). The molecular formula of the silane coupling agent is $R^1$—$SiR_3$, wherein the R is an alkyl group having about one to five carbon atom(s), $R^1$ is an alkyl group having at least one epoxy group. The silane coupling agent may be 3-(glycidoxypropyl) trimethoxvsilane, trimethoxy[2-(7-oxabicyclo [4.1.0]hept-3-yl)ethyl]-silane, 3-(glycidoxypropyl) trimethoxvsilane, trimethoxy[2-(7-oxabicyclo [4.1.0]hept-3-yl) propyl]-silane, or trimethoxy[2-(7-oxabicyclo [4.1.0]hept-3-yl) butyl]-silane. In the embodiment, the silane coupling agent is 3-(glycidoxypropyl) trimethoxvsilane.

The leveling agent may be polydimethy siloxane, phenyltrimethoxysilane, or silicone-modified polysiloxane.

The isopropyl alcohol and the ethanol are used as diluent.

The acetic acid solution is for promoting the hydrolysis of the silane coupling agent.

After hydrolysis, the epoxy group is hydrolyzed into hydroxyl group to produce silanol which contains Si—OH.

(2) A substrate 11 having a metallic coating 13 formed thereon is provided.

The substrate 11 may be made of plastic, metal or glass. In the embodiment, a base paint 12 is formed between the substrate 11 and the metallic coating 13.

(3) A protecting layer 14 is formed on the metallic coating 13.

The spaying liquid is sprayed on the metallic coating 13. The substrate 11 is then baked at an internal oven temperature of about 95° C. to about 105° C. for about 40 min to about 50 min to form the protecting layer 14 on the metallic coating 13.

During the baking treatment, silanol of the spaying liquid is condensed, the Si—OH group reacts with the hydroxyl group at the surface of the metallic coating 13 to dehydrate and produce Si—O—M (M may be a metal ion in the metallic coating 13), which enhances the bond between the protecting layer 14 and the metallic coating 13.

(4) A painting layer 15 is formed on the protecting layer 14.

The painting layer 15 and protecting layer 14 mainly contain organic compounds. The organic molecule(s) of the protecting layer 14 entwine with the chain molecule(s) of the painting layer 15, thus improving the bond between the protecting layer 14 and the painting layer 15.

In the embodiment, the painting layer 15 is made of ultraviolet (UV) curable paint having activated group(s). In the embodiment, the UV curable paint is polyurethane paint. The activated group such as —NHCOO— group reacts with epoxy group of the silane coupling agent, which further enhance the bond between the protecting layer 14 and the painting layer 15.

A housing 10 manufactured by the above method is also provided. The housing 10 includes a substrate 11, a base paint 12 formed on the substrate 11, a metallic coating 13 formed on the base paint 12, a protecting layer 14 formed on the metallic coating 13, and a painting layer 15 formed on the protecting layer 14. The painting layer 15 may be transparent. The protecting layer 14 has a thickness of about 0.8 micrometer (μm) to about 1.2 μm. The protecting layer 14 is made of silane coupling agent. The protecting layer 14 contains material having the chemical formula

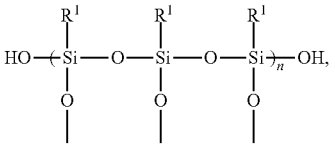

wherein the $R^1$ is an alkyl group having at least one epoxy group.

A Si—O—M (M may be metal ion in the metallic coating 13) bond forms between the protecting layer 14 and the metallic coating 13 at the interface. In the embodiment, the painting layer 15 includes activated group(s) which can reacts with epoxy group. The activated group may be —NHCOO— group.

In an alternative embodiment, the base paint 12 is omitted, in which the metallic coating 13 is directly formed on the substrate 11.

EXAMPLE (1) A spraying liquid was provided.

The spraying liquid was manufactured by the following steps:

(a) a coupling agent solution was produced by mixing a silane coupling agent and a leveling agent, the mass percentage of the leveling agent with regard to the coupling agent solution is about 3%;

(b) 3 parts of coupling agent solution by mass, 85 parts of isopropyl alcohol by mass, 5 parts of ethanol by mass, 5 parts of water by mass, and 2 parts of acetic acid solution by mass were mixed to produce a mixture;

(c) the mixture was stirred and left standing for about 30 min to hydrolyze the silane coupling agent, thus producing a transparent spraying liquid.

(2) A substrate 11 having a metallic coating 13 formed thereon was provided.

(3) A protecting layer 14 was formed on the metallic coating 13. The spraying liquid was sprayed on the metallic coating 13. The substrate 11 was then baked at an internal oven temperature of about 100° C. for about 40 min to form the protecting layer 14 on the metallic coating 13.

(4) A painting layer 15 was formed on the protecting layer 14.

The sample created by example was subjected to the cross-hatch adhesion test according to the ASTM-D3359 "Standard Test Methods for Measuring Adhesion by Tape Test". The sample achieves a test value of 4B.

It is to be understood, however, that even through numerous characteristics and advantages of the exemplary disclosure have been set forth in the foregoing description, together with details of the system and function of the disclosure, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A housing comprising:

a substrate;

a metallic coating formed on the substrate;

a protecting layer formed directly on the metallic coating, the protecting layer comprising material having a chemical formula of

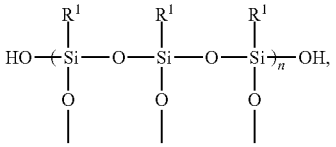

wherein the R1 is an alkyl group having at least one epoxy group; a Si—O—M (M may be metal ion in the metallic coating 13) bond forms between the protecting layer and the metallic coating at the interface, wherein the M is a metal ion of the metallic coating; and a painting layer formed directly on the protecting layer.

2. The housing of claim 1, wherein the protecting layer has a thickness of about 0.8 μm to about 1.2 μm.

3. The housing of claim 1, wherein the housing further comprises a base paint formed between the substrate and the metallic coating.

4. The housing of claim 1, wherein the painting layer comprises activated group(s) which reacts with epoxy group of the silane coupling agent.

5. The housing of claim 4, wherein the activated group is a —NHCOO— group.

6. The housing of claim 4, wherein the painting layer is transparent.

* * * * *